US008699933B2

(12) United States Patent
Katano et al.

(10) Patent No.: US 8,699,933 B2
(45) Date of Patent: Apr. 15, 2014

(54) FIXATION DEVICE, IMAGE FORMING APPARATUS, AND FIXATION FLUID STORAGE CONTAINER

(75) Inventors: Yasuo Katano, Kanagawa (JP); Tsuneo Kurotori, Tokyo (JP); Yuko Arizumi, Kanagawa (JP); Shigeo Takeuchi, Kanagawa (JP); Takahiko Matsumoto, Kanagawa (JP); Yukimichi Someya, Saitama (JP); Fuminari Kaneko, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 303 days.

(21) Appl. No.: 13/142,671

(22) PCT Filed: Jan. 14, 2010

(86) PCT No.: PCT/JP2010/050739

§ 371 (c)(1),
(2), (4) Date: Jun. 29, 2011

(87) PCT Pub. No.: WO2010/092862

PCT Pub. Date: Aug. 19, 2010

(65) Prior Publication Data

US 2011/0268480 A1 Nov. 3, 2011

(30) Foreign Application Priority Data

Feb. 13, 2009 (JP) ..... 2009-030590
Jul. 16, 2009 (JP) ..... 2009-167327

(51) Int. Cl.
*G03G 15/20* (2006.01)

(52) U.S. Cl.
USPC ..... 399/340; 399/320; 425/206

(58) Field of Classification Search
USPC ..... 399/320, 340
See application file for complete search history.

(56) References Cited

U.S. PATENT DOCUMENTS 5,666,628 A 9/1997 Fukai
2004/0131402 A1 7/2004 Kurotori et al.

(Continued)

FOREIGN PATENT DOCUMENTS

JP 59 119364 7/1984
JP 3290513 3/2002

(Continued)

OTHER PUBLICATIONS

Machine translation of JP2010271503A.*

(Continued)

*Primary Examiner* — David Gray
*Assistant Examiner* — Francis Gray
(74) *Attorney, Agent, or Firm* — Oblon, Spivak, McClelland, Maier & Neustadt, L.L.P.

(57) ABSTRACT

Disclosed is, for example, a fixation device of fixing a resin-containing fine particle, the fixation device being configured to foam a fixation fluid including at least a softening agent configured to dissolve or swell at least one portion of a resin to soften the resin-containing fine particle including a resin, a foaming agent, and water, and to provide a foamed fixation fluid to the resin-containing fine particle, the fixation device including a first storage part configured to contain a softening agent fluid including at least the softening agent, a second storage part configured to contain a foaming agent fluid including at least the foaming agent, and a mixed foamed fixation fluid producing part configured to mix and foam both fluids contained in independent states in the storage parts to produce the foamed fixation fluid.

14 Claims, 8 Drawing Sheets

(56) References Cited

U.S. PATENT DOCUMENTS

| | | | | |
|---|---|---|---|---|
| 2008/0063446 | A1* | 3/2008 | Katano et al. | 399/340 |
| 2008/0069612 | A1* | 3/2008 | Nakamura et al. | 399/340 |
| 2008/0213002 | A1 | 9/2008 | Katano et al. | |
| 2009/0003903 | A1 | 1/2009 | Katano et al. | |
| 2009/0067904 | A1* | 3/2009 | Katano et al. | 399/339 |

FOREIGN PATENT DOCUMENTS

| | | |
|---|---|---|
| JP | 2004 109747 | 4/2004 |
| JP | 2004 109749 | 4/2004 |
| JP | 2007 003780 | 1/2007 |
| JP | 2007 25067 | 2/2007 |
| JP | 2008 185704 | 8/2008 |
| JP | 2008 197188 | 8/2008 |
| JP | 2009 8967 | 1/2009 |
| JP | 2010271503 A * | 12/2010 |

OTHER PUBLICATIONS

International Search Report issued Feb. 16, 2010 in PCT/JP10/050739 filed Jan. 14, 2010.

* cited by examiner

FIXATION DEVICE, IMAGE FORMING APPARATUS, AND FIXATION FLUID STORAGE CONTAINER

TECHNICAL FIELD

The present invention relates to a fixation device, an image forming apparatus, and a fixation fluid storage container.

BACKGROUND ART

An image forming apparatuses such as a printer, a facsimile machine, or a copying machine is an apparatus for forming an image including a character or a symbol on recording medium such as a paper sheet, a cloth sheet, or an OHP sheet based on image information. In particular, an electrophotographic image forming apparatus may form a high-definition image on a plain paper sheet at a high speed, and hence, has widely been used in offices. For such an electrophotographic image forming apparatus, a thermal fixation method has been used widely in which a toner on a recording medium is heated and melted by means of heating and a melted toner is pressed whereby the toner is fixed onto the recording medium. This thermal fixation method may provide high speed fixation, high image quality fixation, or the like, and hence, has been used preferably.

However, more than half of the electric power consumption of such an electrophotographic image forming apparatus is consumed for heating a toner in the thermal fixation method. Therefore, a fixation device with a low electric power consumption (energy saving) is desired from the viewpoint of environmental conservation in recent years. That is, a fixation method is desired in which a temperature at which a toner is heated in order to fix the toner is extremely lowered more than ever or it is unnecessary to heat a toner. In particular, a non-heating fixation method for fixing a toner on a recording medium without heating the toner at all is ideal from the viewpoint of low electric power consumption.

For such a non-heating fixation method, for example, Japanese Patent No. 3,290,513 proposes a wet toner fixation method wherein an oil-in-water-type fixing agent in which an organic compound being capable of dissolving or swelling a toner and being insoluble or difficult to be dissolved in water is dispersed and mixed in water is sprayed or dropped onto a surface of a substrate to be subjected to fixation on which an unfixed toner is arranged at a predetermined position so that the toner is dissolved or swelled, and subsequently the substrate to be subjected to fixation is dried out.

However, when a large mount of a fixing agent is provided to an unfixed toner in the wet fixation method of Japanese Patent No. 3,290,513, a recording medium (substrate to be subjected to fixation) such as a transfer paper sheet may absorb water contained in the fixing agent so as to cause cockle or curl of the recording medium, because an oil-in-water-type fixing agent is used in which an organic compound being insoluble or difficult to be dissolved in water is dispersed and mixed in water. Thereby, stable and high-speed conveyance of a recording medium as may be required for an image forming apparatus may be impaired significantly. Herein, if a large amount of water contained in a fixing agent is evaporated by using a drying device so as to remove water contained in a fixing agent provided to a recording medium, an amount of electric power may be required which is comparable to an electric power consumption of an image forming apparatus using a thermal fixation method.

Furthermore, some kinds of oily fixation liquids in which a material for dissolving or swelling a toner is dissolved in an oily solvent have conventionally been proposed for a fixation liquid that does not repel an unfixed toner subjected to a water repellent treatment. For one of them, for example, Japanese Patent Application Publication No. 2004-109749 proposes a fixation liquid in which a material for dissolving or swelling a resin component constituting a toner, such as an aliphatic dibasic acid ester as a component, is diluted (or dissolved) in a nonvolatile dimethyl silicone as a diluent (or solvent). Moreover, Japanese Patent Application Publication No. 59-119364 proposes a solution for fixing an unfixed toner image in a miscible state, which is provided by mixing 8 to 120 parts by volume of a silicone oil with 100 parts by volume of a solvent dissolving a toner and having a miscibility with the silicone oil, for a fixation solution that may be used for a fixation method in which an unfixed image formed by means of an electrostatic method may be fixed on an image receiving sheet sharply and readily without disturbing the image. Such an oily fixation liquid contains an oily solvent having a high affinity with an unfixed toner subjected to a water repellent treatment, and accordingly, it may be possible to dissolve or swell a toner and fix the toner on a recording medium without repelling the unfixed toner subjected to a water repellent treatment.

Moreover, Japanese Patent Application Publication No. 2004-109747 and Japanese Patent Application Publication No. 2009-008967 propose techniques for providing a fixation liquid in a foam state so as to reduce the density of the liquid and eliminate the influence of the surface tension of the liquid whereby fixation with an applied fixation liquid whose amount is extremely smaller than a conventional amount may be conducted without disturbing a toner image.

A configuration for providing a fixation liquid to an unfixed toner layer is provided in any of the above-mentioned patent documents, but, in a configuration for applying a fixation liquid to an unfixed toner layer 3 on a recording medium 2 by using an application roller 1 as a contact application part as illustrated in FIGS. 8A and 8B, when the thickness of a fixation liquid layer 4 on the application roller 1 is smaller than that of the unfixed toner layer 3 in order to provide a small amount of the fixation liquid to the recording medium 2 as illustrated in FIG. 8A, an unfixed toner particle(s) may be attracted by a surface tension produced by a liquid film of the fixation liquid on the surface of the application roller 1 at a position at which the application roller 1 leaves the recording medium 2, causing the toner particle(s) to adhere to the surface of the application roller 1, and accordingly, an image on the recording medium 2 may be disturbed considerably.

On the contrary, when the thickness of the fixation liquid layer 4 on the application roller 1 is sufficiently larger than that of the unfixed toner layer 3 as illustrated in FIG. 8B, a surface tension provided by a liquid film on the surface of the application roller 1 may be unable to act on a toner particle(s) directly at a position at which the application roller 1 leaves the recording medium 2 because of a large amount of the liquid and no toner may adhere to the roller, but a large amount of the fixation liquid is applied on a paper surface, and accordingly, a toner particle(s) may be moved by an excess amount of the fixation liquid on the recording medium 2 so as to cause image degradation or to provide a long drying time period thereby causing a problem in its fixation responsiveness. Furthermore, a significant extent of residual liquid feeling (wet feeling when a paper sheet is touched by a hand) is produced on a paper sheet. Moreover, when the fixation liquid contains water and when a large amount thereof is applied to a medium containing a cellulose such as a paper sheet, the medium such as a paper sheet may curl significantly and jamming of a paper sheet may be caused at the time of conveyance of a medium such as a paper sheet in an apparatus such as an image forming apparatus. Hence, it may be very difficult for such a configuration for conducting roller application with a fixation liquid to attain both application of a small amount of a fixation fluid to a toner layer on a paper sheet for improvement of its fixation responsiveness, reduction of a residual liquid feeling or prevention of its curl, and prevention of toner offset onto a fixation roller. Also, when a die coat part, a blade application part, or a wire bar application part is used as a contact application part and when a small amount of a fixation fluid is provided, a toner may adhere to the contact application part due to its surface tension and image degradation may be caused.

As described above, it may be very difficult for a contact application part and a conventional fixation liquid formulation to attain both application of a small amount of a fixation liquid to a toner layer on a paper sheet to improve its fixation responsiveness and its uniform application without disturbing a toner image. Furthermore, the above-mentioned problem is not necessarily limited to a toner on a recording medium but may occur in a configuration for providing a fixation fluid in a liquid state to a resin-containing fine particle layer on a medium in any case.

Meanwhile, an anionic surfactant may be generally suitable for a foaming agent suitable for a foam-like fixation fluid. The foaming property of such an anionic surfactant is maximally exerted for a liquid in a weak-alkaline state in which its pH is 7 or more. Meanwhile, a softening agent for softening a resin such as a toner in a fixation fluid may have an ester group in most cases and hydrolysis of such an ester group may occur in an alkaline state in which its pH is 7 or greater so that the softening agent may be decomposed chemically and the ability of the softening agent may be lost. Hence, if the pH of a fixation fluid is 7 or more to enhance the foaming property of the fluid, a problem may be caused such that a softening agent may be decomposed chemically in a storage container for a long period of time for storage of the fixation fluid causing so that its fixation ability to be lost and the reliability of a fixation device may be impaired. If a weak-acidic state is provided in which its pH is 6 or less, the chemical decomposition of a softening agent may be suppressed, but the property of a foaming agent may be degraded causing foaming of a fixation fluid not be attained well and formation of a foam film to be disturbed, thereby causing defective fixation.

DISCLOSURE OF THE INVENTION

According to one aspect of the present invention, there may be provided a fixation device of fixing a resin-containing fine particle, the fixation device being configured to foam a fixation fluid including at least a softening agent configured to dissolve or swell at least one portion of a resin to soften the resin-containing fine particle including a resin, a foaming agent, and water, and to provide a foamed fixation fluid to the resin-containing fine particle, the fixation device including a first storage part configured to contain a softening agent fluid including at least the softening agent, a second storage part configured to contain a foaming agent fluid including at least the foaming agent, and a mixed foamed fixation fluid producing part configured to mix and foam both fluids contained in independent states in the storage parts to produce the foamed fixation fluid.

According to another aspect of the present invention, there may be provided an image forming apparatus including an image forming part configured to conduct an electrostatic recording process with a toner to form an unfixed toner image on a medium, a resin-containing fine particle in the toner including a coloring agent, and a fixation part configured to fix the unfixed toner image on the medium, the fixation part including the fixation device as described above.

According to another aspect of the present invention, there may be provided a fixation fluid storage container of containing a fixation fluid, the fixation fluid being provided by producing a mixed fluid including at least a softening agent configured to dissolve or swell at least one portion of a resin to soften a resin-containing fine particle including a resin, a foaming agent, and water, and foaming the mixed fluid, the mixed fluid being provided to the resin-containing fine particle to fix the resin-containing fine particle, the fixation fluid storage container including a first storage part configured to contain a softening agent fluid including at least the softening agent, and a second storage part configured to contain a foaming agent fluid including at least the foaming agent, wherein the fixation fluid storage container is configured such that the softening agent fluid is independent of the foaming agent fluid.

Figure 1:
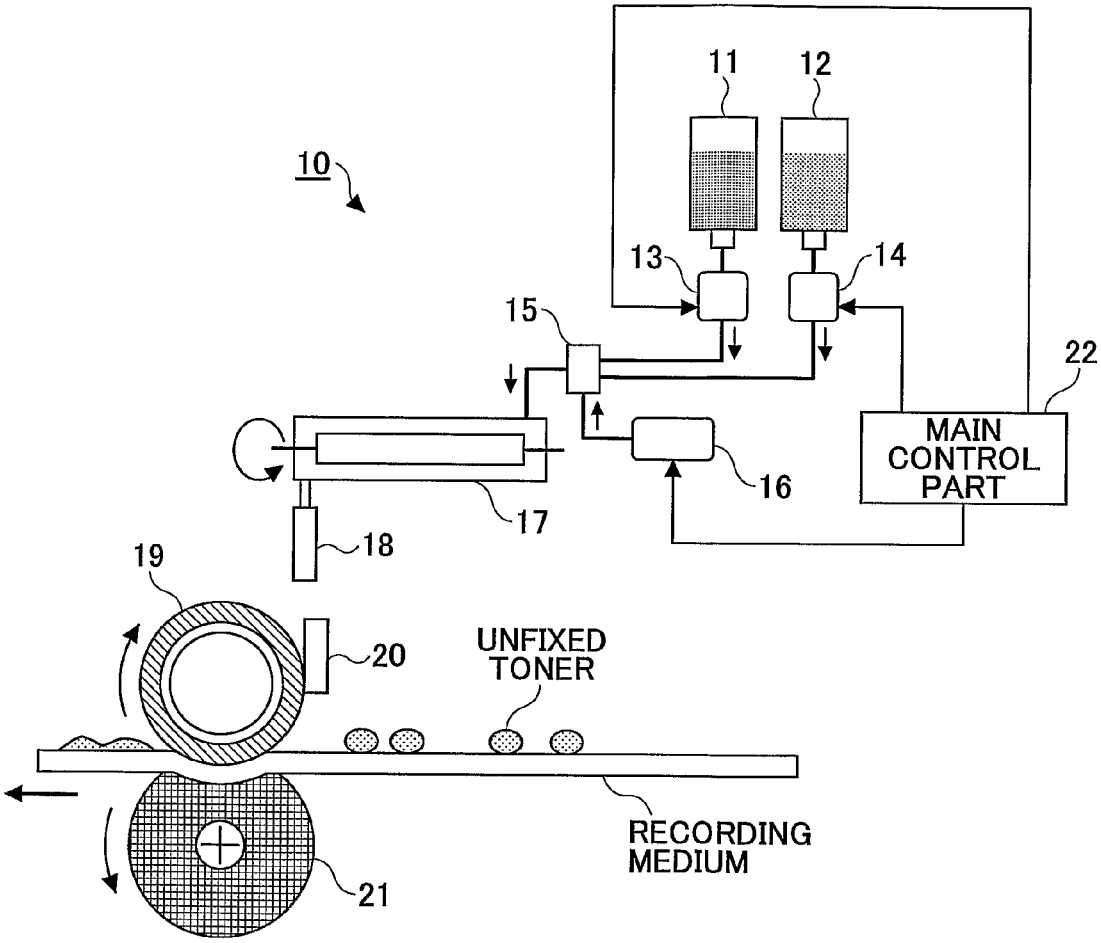
FIG. 1 is a schematic structural diagram illustrating a structure of a fixation device according to a first illustrative embodiment of the present invention.

| EXPLANATION OF LETTERS OR NUMERALS | |
|---|---|
| 10: | Fixation device, |
| 11: | Softening agent fluid sealing container, |
| 12: | Foaming agent fluid sealing container |
| 13: | Fluid delivery pump |
| 14: | Fluid delivery pump |
| 15: | Bubbling vessel |
| 16: | Air pump |
| 17: | Foam-like fixation fluid producing part |
| 18: | Feed orifice |
| 19: | Application roller |
| 20: | Foam film control blade |
| 21: | Pressurizing roller |
| 22: | Main control part |
| 23: | Agitation part |
| 30: | Fixation device |
| 31: | Agitation mechanism |
| 40: | Fluid mixing part |
| 41: | Softening agent fluid flow channel |
| 42: | Foaming agent fluid flow channel |

-continued

| EXPLANATION OF LETTERS OR NUMERALS | |
|---|---|
| 43: | Mixed fluid flow channel |
| 51: | Fixation fluid storage container |
| 52: | Container |
| 53: | Container |
| 56: | Sealing rubber |
| 57: | Sealing rubber |
| 58: | Feed pipe |
| 59: | Feed pipe |
| 61: | Fixation fluid storage container |
| 62: | Foaming agent storage container |
| 63: | Softening agent storage container |
| 64: | Pressurizing plate |
| 65: | Pressurizing plate |
| 68: | Mixed fluid flow channel |
| 69: | Sealing rubber |
| 71: | Pressurization actuator |
| 72: | Pressurization actuator |
| 100: | Image forming apparatus |

BEST MODE FOR CARRYING OUT THE INVENTION

At least one embodiment of the present invention may relate to at least one of a fixation device, an image forming apparatus, and a fixation fluid storage container, and in particular, may relate to a technique for fixing a toner which is a resin-containing fine particle by using a fixation fluid for fixing a resin-containing fine particle onto a medium.

At least one embodiment of the present invention may solve at least one of the above-mentioned problem(s), for example, solve a problem of chemical decomposition of a softening agent during storage of a fixation fluid for a long period of time without deteriorating its foaming property so as to improve a storage stability of fixation fluid drastically, and/or to aim to provide a reliable fixation device, fixation fluid storage container and image forming apparatus.

A fixation device according to an embodiment of the present invention may foam a fixation fluid which contains at least a softening agent for dissolving or swelling at least one portion of a resin so as to soften a resin-containing fine particle which contains a resin, a foaming agent, and water, and may provide a foamed foam-like fixation fluid to the resin-containing fine particle so as to fix it while a film thickness thereof is controlled, in order to solve the at least one of the above-mentioned problem(s). Then, a fixation device according to an embodiment of the present invention may be characterized by including a first storage part for containing a softening agent fluid which contains at least the softening agent, a second storage part for containing a foaming agent fluid which contains at least the foaming agent, and a mixed foam-like fixation fluid producing part for mixing and foaming both fluids contained in their independent states by the respective storage parts so as to produce a foam-like fixation fluid. Furthermore, a pH of a softening agent fluid contained in the first storage part is adjusted to have an acidic property and a pH of a foaming agent fluid contained in the second storage part is adjusted to have an alkaline property. Accordingly, it may be possible to improve a storage stability of a fixation fluid drastically without deteriorating its foaming property and/or provide a reliable fixation device.

Furthermore, the mixed foam-like fixation fluid producing part may include a mixed fluid producing part for mixing both fluids contained in their independent states by the respective storage parts so as to produce a mixed fluid and a foam-like fixation fluid producing part for foaming the mixed fluid so as to produce a foam-like fixation fluid. Accordingly, a uniformity of dissolution or dispersion of both fluids at a time of mixing may be improved so as to stabilize a fixation quality.

Moreover, it may be preferable to conduct production of a foam-like fixation fluid by the mixed foam-like fixation fluid producing part at a time of starting of the device.

Furthermore, the mixed fluid producing part may include an agitation mechanism, whereby a uniformity of dissolution or dispersion of both fluids at a time of mixing may be further improved so as to stabilize a fixation quality.

Moreover, it may include feed channels for feeding a softening agent fluid and a foaming agent fluid from the first storage part and the second storage part, respectively, wherein a fluid resistance of a channel junction at which the respective feed channels join together is smaller than a fluid resistance of each feed channel. Accordingly, it may be possible to conduct uniform dissolution or dispersion of both fluids without providing a special agitation mechanism and miniaturization of a fixation device or fixation fluid storage container may be facilitated.

An image forming apparatus as another embodiment of the present invention may be characterized by including an image forming part for conducting an electrostatic recording process with a toner in which a resin-containing fine particle contains a coloring agent so as to form an unfixed toner image on a medium and a fixation part for fixing the unfixed toner image on the medium by the fixation device as described above. Accordingly, it may be possible to provide an image forming apparatus with a high storage reliability of a fixation fluid and an excellent standing stability.

Moreover, a fixation fluid storage container as another embodiment of the present invention may contain a fixation fluid for which a mixed fluid which contains at least a softening agent for dissolving or swelling at least one portion of a resin so as to soften a resin-containing fine particle which contains a resin, a foaming agent, and water is produced, then the mixed fluid is foamed, and subsequently it is provided to the resin-containing fine particle so as to fix it. Then, a fixation fluid storage container according to an embodiment of the present invention may be characterized by including a first storage part for containing a softening agent fluid which contains at least a softening agent and a second storage part for containing a foaming agent fluid which contains at least a foaming agent and being provided on a condition that the softening agent fluid is independent of the foaming agent fluid. Accordingly, its miniaturization may be readily achieved and it may be possible to mix both fluids, without a special mechanism at a fixation device side, and it may be possible to improve a storage stability of a fixation fluid.

Furthermore, the first storage part and/or the second storage part may be attachable and detachable, whereby it may be possible to exchange it/them readily.

Moreover, it may include a feed channel for a softening agent fluid and a feed channel for a foaming agent fluid in a container and include a mixing and agitating part for mixing and agitating both fluids at a position at which both of the feed channels join together, whereby it may be possible to mix both fluids better and it may be possible to improve a storage stability of a fixation fluid.

Furthermore, the first storage part may include a first communicating part which communicates with a feed channel for a softening agent fluid and the second storage part may include a second communicating part which communicates with a feed channel for a foaming agent fluid. Accordingly, a storage stability of a fixation fluid may be further improved.

Moreover, the first communicating part may include a sealing rubber for sealing a softening agent fluid to be contained, into which a needle-like feed pipe which communicates with a feed channel for a softening agent fluid at a fixation device side is stuck so as to communicate a containment part of the first storage part with the feed channel for a softening agent fluid at a fixation device side, and the second communicating part may include a sealing rubber for sealing a foaming agent fluid to be contained, into which a needle-like feed pipe which communicates with a feed channel for a foaming agent fluid at a fixation device side is stuck so as to communicate a containment part of the second storage part with the feed channel for a foaming agent fluid at a fixation device side. Accordingly, it may be possible to further improve a storage stability of a fixation fluid.

Furthermore, the first storage part and the second storage part may be containers having an accordion structure and may have a push-out part for pushing a fluid to be contained in each container out thereof, and further, it may be preferable to configure this push-out part by using a pressuring actuator.

In a fixation device according to an embodiment of the present invention, a softening agent fluid and a foaming agent fluid may be contained in their independent states by first and second storage parts, respectively, and then, a foam-like fixation fluid may be produced by mixing and foaming both fluids. Accordingly, a storage stability of a fixation fluid may be improved drastically without deteriorating its foaming property, so as to improve its reliability.

Next, at least one illustrative embodiment of the present invention will be described below with reference to the accompanying drawings.

First, the background and principle of a fixation device according to an illustrative embodiment of the present invention will be outlined below.

There may be a problem that when an aqueous fluid containing an anionic surfactant that may be most excellent in its foaming property on the condition that its pH is 7 or more and 9 or less, in particular, a fatty acid salt, and an aqueous fluid containing a softening agent having an ester group are mixed, the softening agent may be chemically decomposed due to hydrolysis during its long-term storage. Hence, as a solution of such a problem, it may be possible to provide a feature including a method of storing an aqueous fluid containing a foaming agent and an aqueous fluid containing a softening agent at their independent states in a storage container, mixing these aqueous fluids in the container or a fixation device simultaneously with an operation of the fixation device and foaming them immediately so as to manufacture a foam-like fixation fluid, and providing it to a resin fine particle layer such as an unfixed toner adhering to a medium.

However, when an aqueous fluid containing a softening agent (pH≥7) and an aqueous fluid containing a softening agent (pH<7) are mixed simply and foaming (bubbling) thereof is conducted without sufficient mixing, a foam with a high foam density or a foam-like fixation fluid in which a softening agent is not uniformly distributed may be provided, thereby causing fixation with a lacking image or insufficient fixation. This may be a particular problem in the cases where not only two kinds of fluids are mixed simply but also the fluids are foamed immediately after their mixing or simultaneously. That is, an illustrative embodiment of the present invention may be characterized in that an aqueous fluid containing a softening agent (pH≥7) and an aqueous fluid containing a softening agent (pH<7) are stored at their independent states during their storage, and the two fluids are sufficiently mixed and subsequently foamed (bubbled) or the two fluids are mixed and subsequently foamed sufficiently, at the time of a fixation operation, so that a foam-like fixation fluid may be provided in which a softening agent is dissolved or dispersed at boundary interfaces of bubbles uniformly whereby it may be possible to have a desired foam density and provide a uniform fixation fluid application and stable fixation.

Herein, a fixation fluid may contain water as a dilution medium, a softening agent for softening a resin, and a foaming agent for foaming the fixation fluid. Furthermore, an organic solvent having an ester group may be excellent in its resin-softening property for a polyester resin or styrene-acryl resin as a representative resin to be used for a resin fine particle, in particular, a toner particle to be used in an electrophotographic recording technique. For example, dibasic acid esters, alkoxyalkyl esters of fatty acids, cyclic esters such as propylene carbonate, citric acid esters, and the like may be particularly excellent in their toner-resin-softening properties. Meanwhile, a fluid with a pH equal to or more than 7, a fluid with a pH less than 7, a fluid with a pH equal to or more than 7 and less than 10, and a fluid with a pH equal to or more than 4 and less than 7 may be defined as an alkaline fluid, an acidic fluid, a weak-alkaline fluid, and a weak-acidic fluid, respectively, in an illustrative embodiment of the present invention. Meanwhile, it is generally known that these organic solvents having an ester group may readily be hydrolyzed in water. In particular, such hydrolysis may be facilitated in an alkaline liquid in which the pH of the liquid is 8 or more. This may be provided by catalysis of a basic component (such as a sodium ion, a potassium ion, and an amine) contained in an alkaline liquid. Hence, when such a basic component is neutralized in the liquid and a weak-acidic state is provided at which a slight excess of acid is present, it may be possible to suppress hydrolysis of an ester drastically.

Meanwhile, an anionic surfactant as a foaming agent that may be essential for manufacturing a foam-like fixation fluid, in particular, a fatty acid salt such as ammonium myristate, may have the highest foaming property in a weak-alkaline region in which the pH of the fluid is in a range of 7 to 10. This may be because it may be readily able to dissociate a fatty acid salt, to dissolve a fatty acid in water, and to form a micelle of fatty acid, in a weak-alkaline region, whereby it may be possible to retain boundary interfaces of bubbles. On the other hand, it may be impossible to dissociate a fatty acid salt in a weak-acidic fluid so as to be insolubilized like a so-called acid soap and it may be impossible to form a micelle whereby its foaming property may be degraded extremely.

Thus, it may be desirable for a fixation fluid to be weak-alkaline in order to improve the foaming ability of a foaming agent in the fluid but it may be desirable for a fixation fluid to be weak-acidic in order to suppress chemical decomposition of a softening agent in the fluid. Then, in order to solve these conflicting problems, an illustrative embodiment of the present invention has a configuration for retaining a weak-alkaline fluid containing a foaming agent and water in a fixation fluid and a fluid containing a softening agent, either without containing water or while being kept at a weak-acidic state at which its pH is 6 or more and less than 7 even if water is contained, at their separate and independent states, mixing the two fluids at the time of a fixation operation, conducting their foaming immediately after or simultaneously with it at a state at which its pH is 7 or more so as to manufacture foam-like fixation fluid because the foaming property of a fixation fluid may not be degraded after their mixing, and providing the foam-like fixation fluid to an unfixed toner image on a medium such as a paper sheet so as to conduct fixation of the image.

Then, in a configuration for retaining a fixation fluid while a fluid containing a foaming agent (referred to as a foaming agent fluid, below) is separated from a fluid containing a softening agent (referred to as a softening agent fluid, below), it may be desirable for a foaming agent fluid to contain, in particular, a foaming agent, a bubble-increasing agent, water as a dilution medium, and a pH adjuster. For such a foaming agent, anionic surfactants, in particular, fatty acid salts may be desirable, and further, for such a fatty acid salt, amine salts of fatty acids may be desirable. For such a fatty acid, an optimal combination may be selected from lauric acid, myristic acid, palmitic acid, and stearic acid, the carbon numbers of whose alkyl groups are 12, 14, 16, and 18, respectively. For such a salt, sodium salts, potassium salts, and amine salts may be preferable, and in particular, triethanolamine salts and diethanolamine salts may be desirable. For a bubble-increasing agent, there may be provided fatty acid alkanolamides, more particularly, (1:1)-type and (1:2)-type fatty acid alkanolamides, and (1:1)-type ones may be suitable from the viewpoint of foam stability in an illustrative embodiment of the present invention. Furthermore, for a bubble-increasing agent, it may also be suitable to singly provide or mix a polyhydric alcohol(s), in particular, propylene glycol, dipropylene glycol, tripropylene glycol, glycerin, and the like. For a pH adjuster for maintaining the weak-alkaline property of a fluid whose pH is 7 or more and less than 10, amines may be suitable.

Meanwhile, although a softening agent may be provided singly, it may also be desirable for a softening agent fluid to contain a polyhydric alcohol(s) that is/are a component(s) of a bubble-increasing agent for suppressing its hydrolysis, in particular, propylene glycol, dipropylene glycol, tripropylene glycol, and glycerin, singularly or in combination. Furthermore, if a slight amount of water is contained, an advantage may be provided such that its flammability is reduced so as not to require dangerous material handling. When water is contained, it may be desirable to provide a softening agent fluid as a weak acid whose pH is set at 6 or more and less than 7. Herein, when a softening agent fluid is mixed with a foaming agent fluid, it may be desirable to set the concentration of a pH adjustor so as to provide a mixed fluid as a weak acid whose pH is not equal to or less than 7 totally. For a pH adjustor in a softening agent fluid, organic acid salts may be desirable, and sodium salts and potassium salts of lactic acid, citric acid, malic acid, and the like may be suitable.

FIG. 1 is a schematic structural diagram illustrating a structure of a fixation device according to a first illustrative embodiment of the present invention. In a fixation device 10 according to the illustrative embodiment illustrated in the figure, a softening agent fluid and foaming agent fluid for producing a fixation fluid are separately stored in a softening agent fluid sealing container 11 and a foaming agent fluid sealing container 12, respectively, in their independent states. At the time of an operation of the fixation device, a softening agent fluid and a foaming agent fluid are fed from the softening agent fluid sealing container 11 and the foaming agent fluid sealing container 12, respectively, by fluid delivery pumps 13 and 14, respectively, based on a driving control signal from a main control part 22 as described below, so as to provide a desired mixing ratio, and a mixed fluid with such a desired mixing ratio is sent to a bubbling vessel 15. Then, a mixed fluid is bubbled in the bubbling vessel 15 by operating an air pump 16 at the timing of delivery of the mixed fluid thereto, based on a driving control signal from the main control part 22 as described below, so as to produce a foam-like fixation fluid with a large bubble diameter. Then, such a bubble may be so large that it may be possible to observe the bubble visually. A created large bubble(s) is sent to a foam-like fixation fluid producing part 17 for applying a shear force to a bubble so as to provide a fine bubble so as to produce a foam-like fixation fluid. The foam-like fixation fluid producing part 17 has double cylinder members wherein an inner cylinder member rotates around its axis so that a small bubble (s) with a desired bubble diameter is/are produced from a large bubble(s) by a shear force generated between the outer surface of the inner cylinder member and the inner surface of an outer cylinder member. Thus produced foam-like fixation fluid is fed from a feed orifice 18 to a contact zone between a foam film control blade 20 contacting an application roller 19 and the application roller 19, so as to form a desired foam film on the application roller 19. A recording medium such as a paper sheet on which an image of unfixed toner has been formed passes between the application roller 19 and a pressurizing roller 21 opposed thereto, whereby a foam film of a foam-like fixation fluid is provided to the unfixed toner so that a toner resin is softened by a softening agent in the fixation fluid and the toner image is fixed on a paper sheet without heating thereof. Furthermore, the main control part 22 receives a starting signal for the fixation device and controls operations of the fluid delivery pumps 13 and 14 and an operation of the air pump 16 and it may be possible to produce a foam-like fixation fluid by conducting the mixing and foaming in accordance with the timing of delivery of a recording medium such as a paper sheet on which an unfixed toner image has been formed.

Additionally, a foaming agent fluid and a softening agent fluid are mixed at a fluid delivery part, a bubbling vessel, and a bubble foaming part in the configuration of the fixation device 10 according to the present illustrative embodiment, and chemical decomposition of a softening agent may occur when it is left for a long term. Hence, it may be desirable to conduct disposal of a fixation fluid in flow channels from the sealing containers to a foam-like fixation fluid feed orifice at the end of fixation or the start of fixation. Furthermore, it may be desirable that the inner volume of the flow channels from the sealing containers to the foam-like fixation fluid feed orifice is as small as possible because a fixation fluid is consumed wastefully by its disposal.

Figure 2:
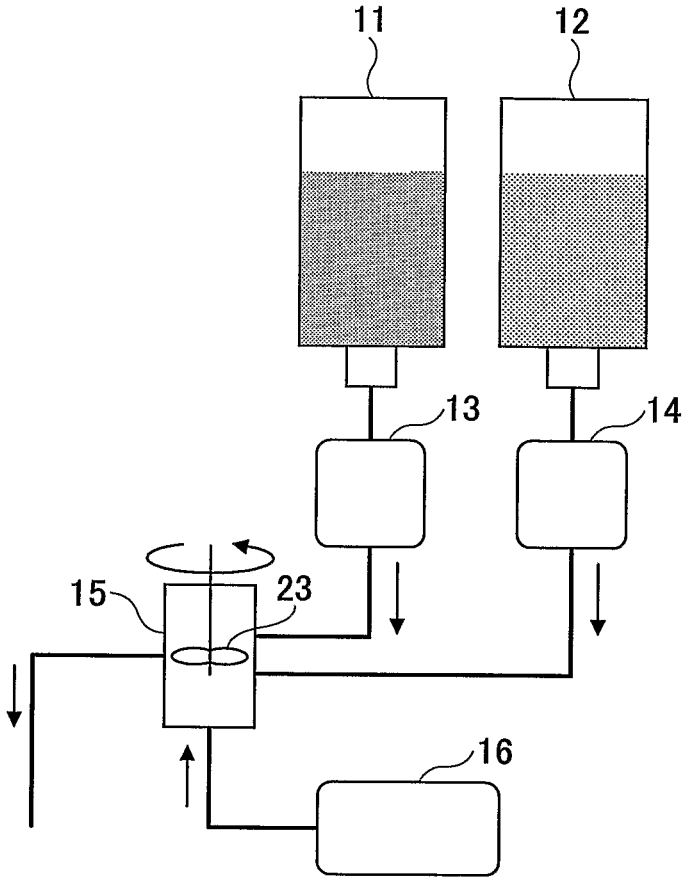
FIG. 2 is a schematic structural diagram illustrating a partial structure of a fixation device according to the first illustrative embodiment.
Figure 3:
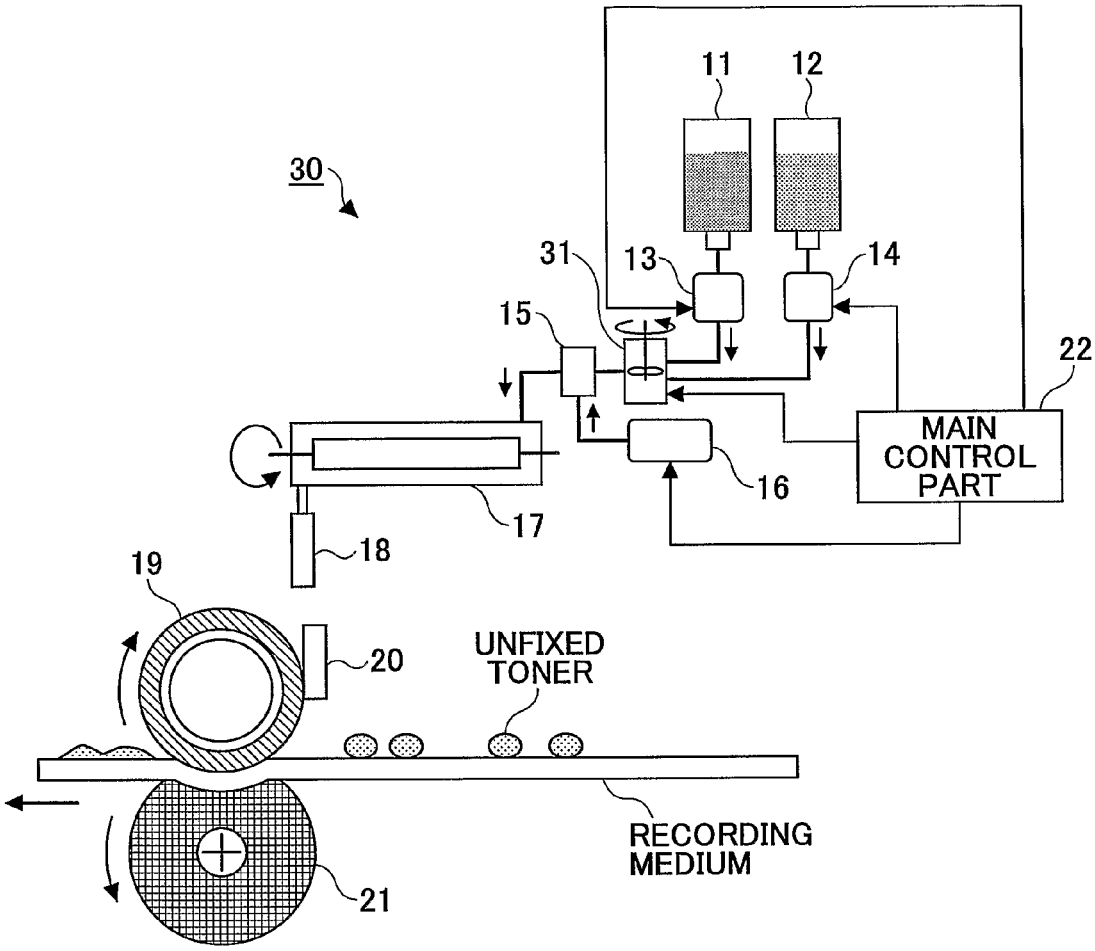
FIG. 3 is a schematic structural diagram illustrating another structure of a fixation device according to the first illustrative embodiment of the present invention.

Furthermore, if a foaming agent fluid and a softening agent fluid are not sufficiently uniformly mixed, a foaming property may be degraded at the time of foaming after their mixing and the density of a foam-like fixation fluid may be higher than a desired value, whereby it may be impossible to form a foam film. Moreover, the softening agent may not uniformly be distributed at boundary interfaces of bubbles whereby fixation may not be uniform. Hence, as illustrated in FIG. 2, the bubbling vessel 15 may also be provided with a configuration for mixing a foaming agent fluid and a softening agent fluid by agitation of an agitation part 23 and vibration caused by bubbling. That is, a fluid mixing part for a foaming agent fluid and a softening agent fluid and a foaming bubbling part for conducting foaming and bubbling thereof are common and such a mixing foaming bubbling part is provided with an agitation mechanism such as a rotating agitation blade. First, both fluids are agitated by the agitation blade and air is sent thereto by an air pump during agitation, so that the fluids are bubbled or a fixation fluid is foamed. Thereby, it may be possible to provide a softening agent uniformly at boundary interfaces of bubbles while foaming is conducted without deteriorating a foaming property. Furthermore, as illustrated in FIG. 3, it may be desirable to provide an agitation mechanism 31 at the location of mixing of both fluids separately in order to improve the compatibility of both fluids at the time of their mixing. In FIG. 3, a rotating agitation blade is incorporated into a mixing vessel so as to provide a configuration for sufficiently agitating and uniformly mixing a foaming agent fluid and a softening agent fluid before foaming and bubbling are conducted. For another agitation method, ultrasonic vibration and the like may be desirable.

Figure 4A:
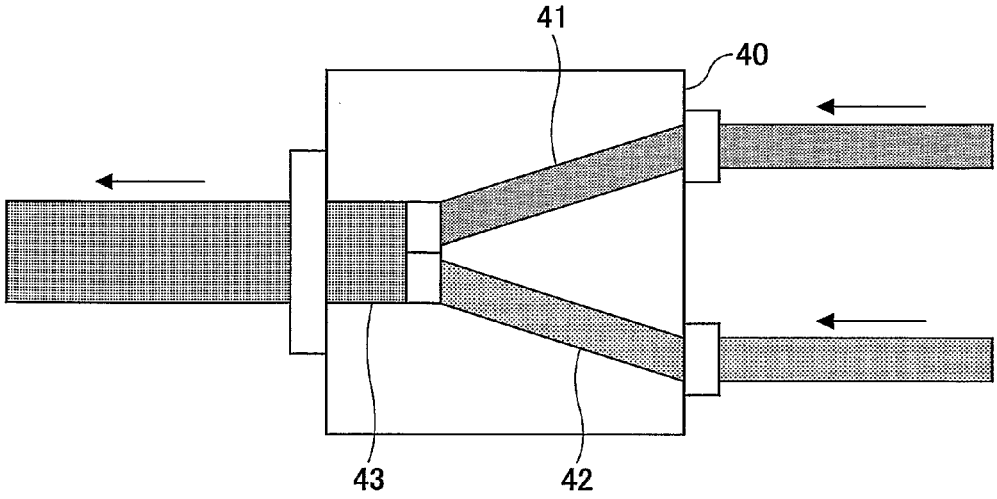
FIGS. 4A and 4B are schematic structural diagrams illustrating a structure of a fluid mixing part.
Figure 4B:
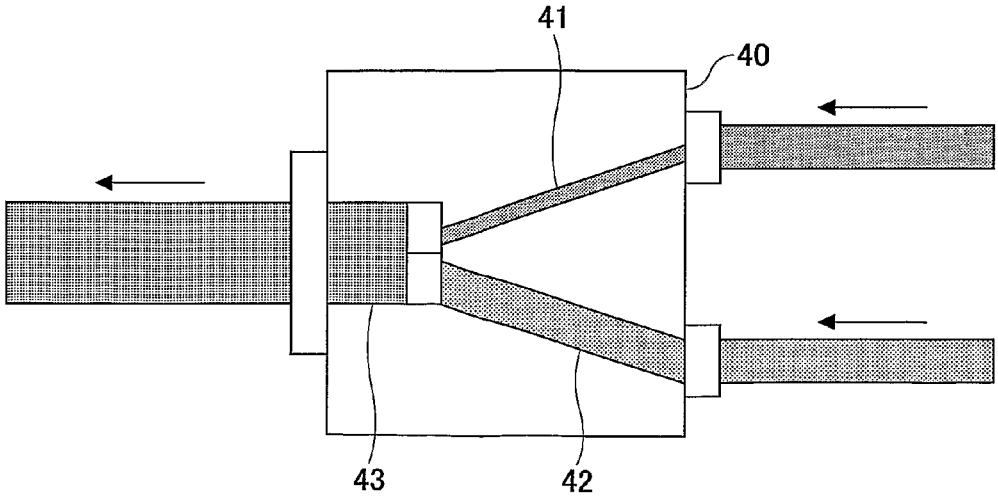

Furthermore, as illustrated in FIGS. 4A and 4B, it may also be suitable to provide a fluid mixing part composed of only a flow channel. It may be possible to attain extremely simple mixing because there is no driving part. A fluid mixing part 40 is composed of a mixed fluid flow channel 43 for mixing for which a softening agent fluid flow channel 41 and a foaming agent fluid flow channel 42 join together. The fluid resistance of the mixed fluid flow channel 43 may be smaller than the fluid resistance of the softening agent fluid flow channel 41 and the resistance of the foaming agent fluid flow channel 42. Thereby, a flow rate in the mixed fluid flow channel 43 may be so high that a turbulent flow is generated, and accordingly, it may be possible to mix a softening agent fluid with a foaming agent fluid sufficiently.

Moreover, as illustrated in FIG. 4B, when the ratio of a reciprocal of the fluid resistance R1 of the softening agent fluid flow channel 41 and a reciprocal of the fluid resistance R2 of the foaming agent fluid flow channel 42 is set to be close to the ratio of the volume 11 of the softening agent fluid flow channel 41 and the volume 12 of the foaming agent fluid flow channel 42 ((1/R1):(1/R2)~I1:I2), it may only be necessary to provide identical feed pressures P1 and P2 of both fluids in order that it may be possible to retain the volume ratio of them after mixing constantly and stably and it may be possible to control a mixing ratio readily.

Next, a fixation fluid storage container that may be suitable for a fixation device according to an embodiment of the present invention will be described below.

Figure 5:
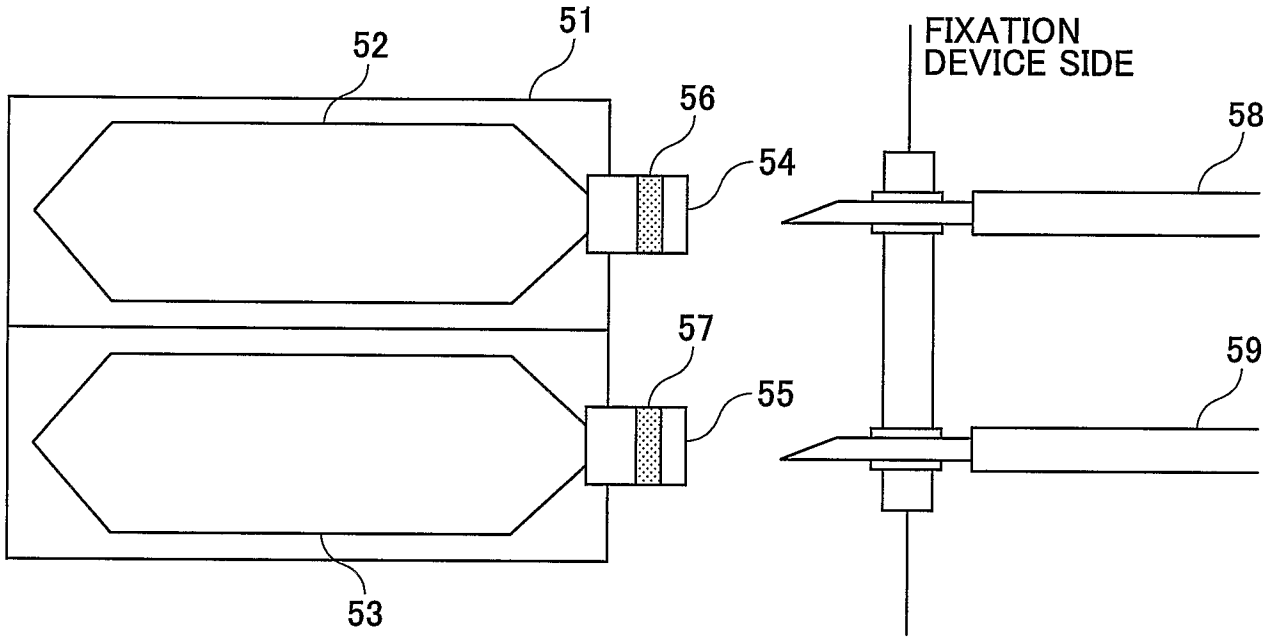
FIG. 5 is a schematic structural diagram illustrating a structure of a fixation fluid storage container according to the first illustrative embodiment of the present invention.

FIG. 5 is a schematic structural diagram illustrating a structure of a fixation fluid storage container according to the first illustrative embodiment of the present invention. In a fixation fluid storage container 51 illustrated in the figure, a foaming agent fluid sealing container 52 and a softening agent fluid sealing container 53 are provided at their independent states. For each container, a resin laminate container with a laminated aluminum foil and the like may be suitable. The ends of fluid containers 52 and 53 are provided with feed orifices 54 and 55, respectively, and such feed orifices 54 and 55 are provided with sealing rubbers 56 and 57 as communication parts, respectively, so as to seal the fluids. When the fixation fluid storage container 51 having such a configuration is installed in a fixation device attachably and detachably, feed pipes 58 and 59 provided with needle-like tips at a fixation device side are opposed to feed orifices 54 and 55 of the fixation fluid storage container 51, respectively, and the needle-like tips of feed pipes 58 and 59 break the sealing rubbers 56 and 57 so as to communicate with both fluid containers. In such a configuration, mixing of fluids in both fluid containers is conduced in a fixation device, and fluid feed pumps may also be installed in the fixation device. According to such a fixation fluid storage container, it may be possible to store a foaming agent fluid and a softening agent fluid at their independent states separately and to ensure no fluid leakage and provide an attachable and detachable configuration with easy exchange.

Figure 6:
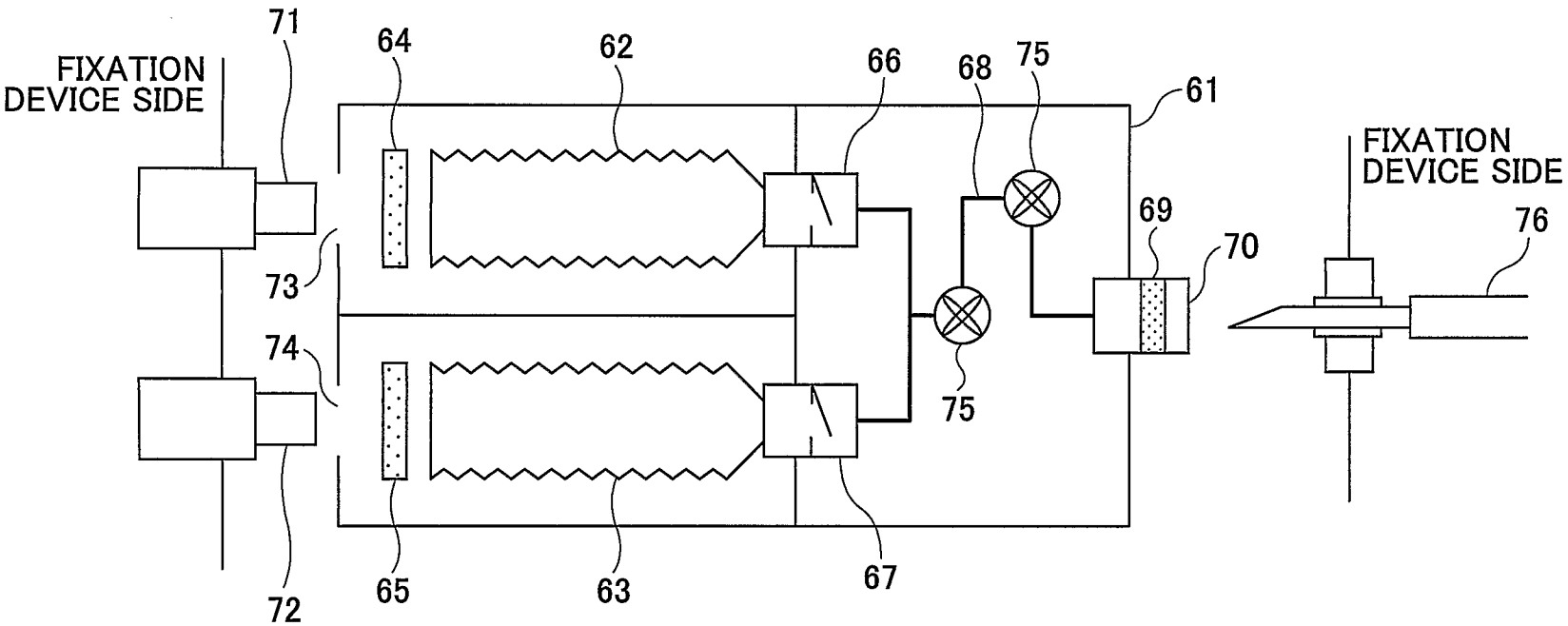
FIG. 6 is a schematic structural diagram illustrating a fixation fluid storage container according to a second illustrative embodiment of the present invention.

FIG. 6 is a schematic cross-section diagram illustrating a structure of another fixation fluid storage container suitable for a fixation device according to an illustrative embodiment of the present invention. A fixation fluid storage container 61 illustrated in the figure includes a foaming agent storage container 62 and softening agent storage container 63 which are containers formed of a resin laminate and having an accordion structure, pressurizing plates 64 and 65 that are movable in parallel for pressurizing fluids contained in the foaming agent storage container 62 and softening agent storage container 63 with accordion structures to push them out of the bottom sides thereof, respectively, feed orifices 66 and 67 of the respective containers, a mixed fluid flow channel 68 for mixing two fluids fed from the respective feed orifices, and a mixed fluid feed orifice 70 provided with a sealing rubber 69 as a communication part. Furthermore, openings 73 and 74 are provided on a container wall of the fixation fluid storage container 61 in order to insert pressurization actuators 71 and 72 for applying pressures to the pressurizing plates 64 and 65. The respective feed orifices 66 and 67 communicate with the mixed fluid flow channel 68 and at least one rotatable agitation blade 75 is provided in the mixed fluid flow channel 68.

When the fixation fluid storage container 61 having such a configuration is attached to a fixation device, there is provided a mechanism for inserting the pressurization actuators 71 and 72 in the fixation device into the openings 73 and 74 on a container wall so as to pushing the pressurizing plates 64 and 65. Meanwhile, the mixed fluid feed orifice 70 is sealed with the sealing rubber 69, and when the fixation fluid storage container 61 is attached to a fixation device, a feed pipe 76 having a needle at the side of the fixation device breaks the sealing rubber and is communicated with the mixed fluid flow channel. At the time of an operation of the fixation device, the pressurization actuators 71 and 72 are actuated so as to push the pressurizing plates 64 and 65, and the foaming agent storage container 62 and softening agent storage container 63 which are containers formed of a resin laminate and having an accordion structure are deformed, whereby the respective fluids are fed from the respective feed orifices 66 and 67 to the mixed fluid flow channel 68. After the feeding, both fluids are mixed by the agitation blade 75 sufficiently so that a fixation fluid in which a softening agent is mixed with a foaming agent uniformly is fed from the mixed fluid feed orifice 70 of the fixation fluid storage container. Additionally, an agitation blade may have a driving source for its rotation and it may also be possible for a configuration of natural rotation due to a fluid flow to obtain a sufficient agitation performance. Because a softening agent fluid has already been mixed with a foaming agent fluid uniformly in the fixation fluid storage container in the configuration of FIG. 6, it may be only necessary to install a foaming or bubbling mechanism at a fixation device side whereby it may be possible to simplify a fixation device.

Herein, a softening agent for dissolving or swelling a resin to soften it includes an aliphatic ester. Such an aliphatic ester may be excellent in a dissolving property or swelling property for dissolving or swelling at least a portion of a resin included in a toner or the like. Furthermore, the acute oral toxicity LD50 of a softening agent may preferably be greater than 3 g/kg, and may more preferably be 5 g/kg or greater, from the viewpoint of safety to a human body. An aliphatic ester may provide high safety to a human body, when used for materials of cosmetics frequently.

Moreover, because fixation of a toner on a recording medium may be conducted in an instrument that is frequently used in a closed environment and a softening agent may remain in a toner after fixation of the toner on a recording medium, fixation of a toner on a recording medium may preferably involve no generation of a volatile organic compound (VOC) or an unpleasant odor. That is, it may be preferable for a softening agent to contain none of volatile organic compounds (VOCs) and materials causing an unpleasant odor. An aliphatic ester may have a higher boiling point and a lower volatility compared to those of organic solvents used generally or commonly (such as toluene, xylene, and ethyl methyl ketone) and may have no irritating odor.

Additionally, an odor index as a practical standard of odor measurement on which it may be possible to measure an odor in an office environment or the like with a high precision may be an odor index based on a so-called three-point-comparison-type smell bag method that is a sensory measurement (10×log (a dilution factor of a material at which no odor of the material is sensed)). Furthermore, the odor index of an aliphatic ester contained in a softening agent may preferably be 10 or less. In this case, no unpleasant odor may be sensed in a normal office environment. Moreover, not only a softening agent but also another or other fluid agent(s) contained in a fixation fluid may preferably have none of unpleasant odors and irritating odors.

In a fixation fluid in an illustrative embodiment of the present invention, the above-mentioned aliphatic ester may preferably include a saturated aliphatic ester. When the above-mentioned aliphatic ester includes a saturated aliphatic ester, it may be possible to improve the storage stability of a softening agent (its resistance against oxidation, hydrolysis, and the like). Furthermore, a saturated aliphatic ester may provide a high safety to a human body, while it may be possible for many of saturated aliphatic esters to dissolve or swell a resin contained in a toner within 1 second. Moreover, it may be possible for a saturated aliphatic ester to lower the stickiness of a toner provided on a recording medium. It is considered that this may be because a saturated aliphatic ester forms an oily film on the surface of a dissolved or swelled toner.

Hence, in a fixation fluid in an illustrative embodiment of the present invention, the above-mentioned saturated aliphatic ester may preferably include a compound represented by a general formula of R1COOR2, wherein R1 is an alkyl group whose carbon number is 11 or more and 14 or less and R2 is a linear or branched alkyl group whose carbon number is 1 or more and 6 or less. If at least one of the carbon numbers of R1 and R2 is less than each desired range, an odor may be generated, and if it is more than the desired range, its resin-softening performance may be degraded.

That is, when the above-mentioned saturated aliphatic ester includes a compound represented by a general formula of R1COOR2, wherein R1 is an alkyl group whose carbon number is 11 or more and 14 or less and R2 is a linear or branched alkyl group whose carbon number is 1 or more and 6 or less, it may be possible to improve its property of dissolving or swelling a resin contained in a toner. Furthermore, the odor index of the above-mentioned compound may be 10 or less so that the above-mentioned compound may have none of unpleasant odors and irritating odors.

For an aliphatic monocarboxylic acid ester that is the above-mentioned compound, it may be possible to provide, for example, ethyl laurate, hexyl laurate, ethyl tridecylate, isopropyl tridecylate, ethyl myristate, isopropyl myristate, and the like. Many of these aliphatic monocarboxylic acid esters which are the above-mentioned compounds may be soluble in an oily solvent but may be insoluble in water. Accordingly, many of the aliphatic monocarboxylic acid esters that are the above-mentioned compounds may be contained in a fixation fluid with an aqueous solvent while a glycol is a dissolution assistant, and thereby, a composition of solution or microemulsion may be provided.

Furthermore, in a fixation fluid in an illustrative embodiment of the present invention, the above-mentioned aliphatic ester may preferably include an aliphatic dicarboxylic acid ester. When the above-mentioned aliphatic ester includes an aliphatic dicarboxylic acid ester, it may be possible to dissolve or swell a resin included in a toner within a shorter period of time. For example, for a high-speed printing of about 60 ppm, it may desirably take 1 second or less to provide a fixation fluid to an unfixed toner on a recording medium whereby the toner is fixed on the recording medium. When the above-mentioned aliphatic ester includes an aliphatic dicarboxylic acid ester, it may be possible that a period of time required for providing a fixation fluid to an unfixed toner or the like on a recording medium whereby the toner is fixed on the recording medium is 0.1 seconds or less. Moreover, it may be possible to dissolve or swell a resin included in a toner by addition of a smaller amount of a softening agent, and accordingly, the content of a softening agent contained in a fixation fluid may be reduced.

Furthermore, in a fixation fluid in an illustrative embodiment of the present invention, the above-mentioned aliphatic dicarboxylic acid ester may preferably include a compound represented by a general formula of $R3(COOR4)_2$, wherein R3 is an alkylene group whose carbon number is 3 or more and 8 or less and R4 is a linear or branched alkyl group whose carbon number is 3 or more and 5 or less. If at least one of the carbon numbers of R3 and R4 is less than each desired range, an odor may be generated, and if it is more than the desired range, its resin-softening performance may be degraded.

That is, when the above-mentioned aliphatic dicarboxylic acid ester includes a compound represented by a general formula of $R3(COOR4)_2$, wherein R3 is an alkylene group whose carbon number is 3 or more and 8 or less and R4 is a linear or branched alkyl group whose carbon number is 3 or more and 5 or less, it may be possible to improve its property of dissolving or swelling a resin contained in a toner. Furthermore, the odor index of the above-mentioned compound may be 10 or less so that the above-mentioned compound may have none of unpleasant odors and irritating odors.

For an aliphatic dicarboxylic acid ester that is the above-mentioned compound, it may be possible to provide, for example, 2-ethylhexyl succinate, dibutyl adipate, diisobutyl adipate, diisopropyl adipate, diisodecyl adipate, diethyl sebacate, dibutyl sebacate, and the like. Many of these aliphatic dicarboxylic acid esters that are the above-mentioned compounds may be soluble in an oily solvent but may be insoluble in water. Accordingly, a glycol as a dissolution assistant may be contained in a fixation fluid with an aqueous solvent, and thereby, a composition of solution or microemulsion may be provided.

Furthermore, in a fixation fluid in an illustrative embodiment of the present invention, the above-mentioned aliphatic ester may preferably include an aliphatic dicarboxylic acid di(alkoxyalkyl)ester. When the above-mentioned aliphatic ester includes an aliphatic dicarboxylic acid di(alkoxyalkyl) ester, it may be possible to improve the fixation property of a toner on a recording medium.

In a fixation fluid in an illustrative embodiment of the present invention, the above-mentioned aliphatic dicarboxylic acid di(alkoxyalkyl) ester may preferably include a compound represented by a general formula of $R5(COOR6\text{-}O\text{—}R7)_2$, wherein R5 is an alkylene group whose carbon number is 2 or more and 8 or less, R6 is an alkylene group whose carbon number is 2 or more and 4 or less, and R7 is an alkyl group whose carbon number is 1 or more and 4 or less. If at least one of the carbon numbers of R5, R6, and R7 is less than each desired range, an odor may be generated, and if it is more than the desired range, its resin-softening performance may be degraded.

That is, when the above-mentioned aliphatic dicarboxylic acid di(alkoxyalkyl)ester includes a compound represented by a general formula of $R5(COOR6\text{-}O\text{—}R7)_2$, wherein R5 is an alkylene group whose carbon number is 2 or more and 8 or less, R6 is an alkylene group whose carbon number is 2 or more and 4 or less and R7 is an alkyl group whose carbon number is 1 or more and 4 or less, it may be possible to improve its property of dissolving or swelling a resin contained in a toner. Furthermore, the odor index of the above-mentioned compound may be 10 or less, so that the above-mentioned compound may have none of unpleasant odors and irritating odors.

For an aliphatic dicarboxylic acid di(alkoxyalkyl)ester that is the above-mentioned compound, it may be possible to provide, for example, di(ethoxyethyl)succinate, di(butoxyethyl)succinate, di(ethoxyethyl)adipate, di(butoxyethyl)adipate, di(ethoxyethyl)sebacate, and the like. These aliphatic dicarboxylic acid di(alkoxyalkyl)esters may be contained in a fixation fluid with an aqueous solvent while a glycol is a dissolution assistant, and thereby, a composition of solution or microemulsion may be provided.

For another or other aliphatic ester(s), aliphatic dicarbitol esters, for example, dicarbitol succinate and dicarbitol adipate, citric acid esters, cyclic esters such as ethylene carbonate and propylene carbonate, may also be suitable for a softening or lubricating agent(s).

Figure 7A:
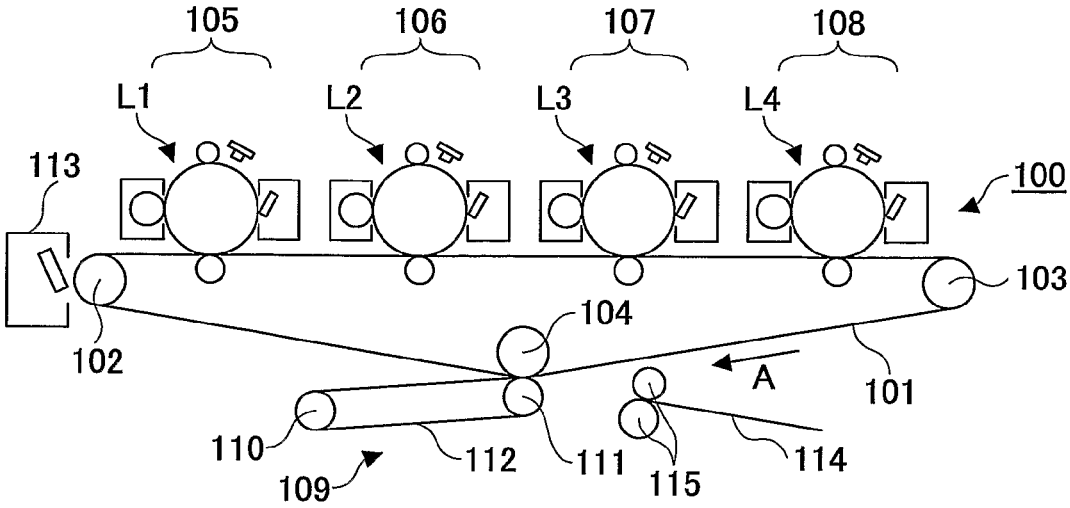
FIGS. 7A and 7B are schematic structural diagrams illustrating a structure of an image forming apparatus according to the first illustrative embodiment of the present invention.
Figure 7B:
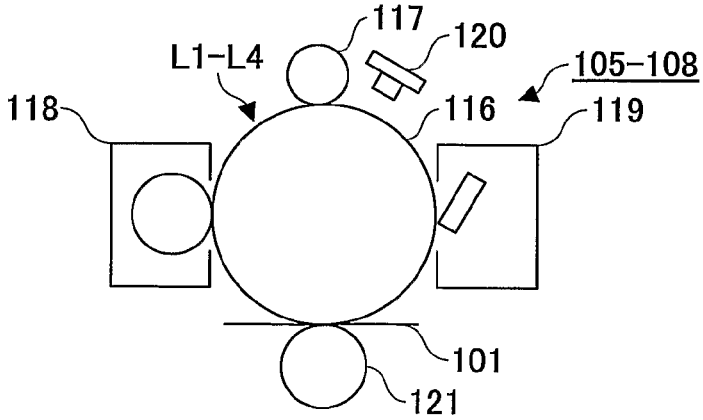
Figure 8A:
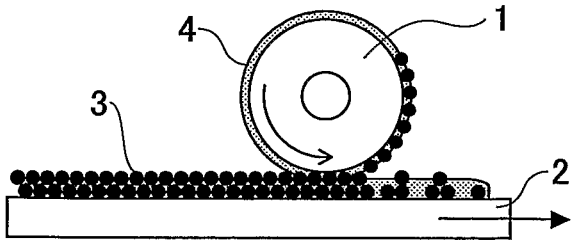
FIGS. 8A and 8B are schematic cross-sectional diagrams illustrating a situation of offset caused by a conventional fixation device.
Figure 8B:
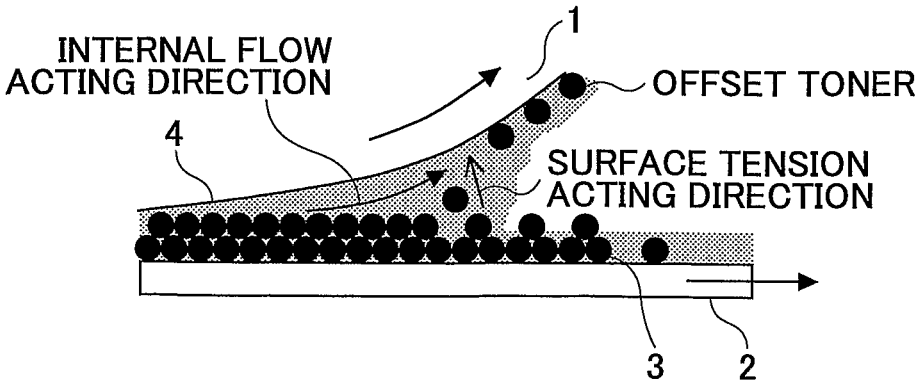

FIGS. 7A and 7B are schematic structural diagrams illustrating a structure of an image forming apparatus according to another illustrative embodiment of the present invention. An image forming apparatus illustrated in the figures may be a copying machine or a printer. FIG. 7A is a schematic diagram of the whole of a tandem-type electrophotographic color image forming apparatus and FIG. 7B is a diagram illustrating the structure of one image forming unit of the image forming apparatus in FIG. 7A. An image forming apparatus 100 illustrated in FIGS. 7A and 7B includes an intermediate transfer belt 101 as a toner image carrier. The intermediate transfer belt 101 extends on and engages with three supporting rollers 102-104 and rotates in the direction of an arrow A in the figure. For the intermediate transfer belt 101, each of black, yellow, magenta, and cyan image forming units 105-108 is arranged. Above these image forming units, light exposure devices that are not illustrated in any of the figures are arranged. For example, when the image forming apparatus is a copying machine, image information of an original document is read by a scanner, and exposure lights L1-L4 for writing electrostatic latent images onto its respective photoconductor drums, respectively, are radiated from the light exposure devices depending on the image information. A secondary transfer device 109 is provided at a location opposing to the supporting roller 104 for the intermediate transfer belt 101 while interposing the intermediate transfer belt 101. The secondary transfer device 109 is composed of a secondary transfer belt 112 extending on and engaging with two supporting rollers 110 and 111. Additionally, a transfer roller as well as a transfer belt may be used for the secondary transfer device 109. Furthermore, a belt cleaning device 113 is arranged at a location opposing to the supporting roller 102 for the intermediate transfer belt 101 while interposing the intermediate transfer belt 101. The belt cleaning device 113 is arranged to remove a toner remaining on the intermediate transfer belt 101.

A recording paper sheet 114 as a recording medium is introduced into a secondary transfer part by a pair of paper feeding rollers 115, and when a toner image is transferred to the recording paper sheet 114, the secondary transfer belt 112 is pressed against the intermediate transfer belt 101 thereby conducting transfer of the toner image. The recording paper sheet 114 to which the toner image is transferred is conveyed by the secondary transfer belt 112 and the unfixed toner image transferred to the recording paper sheet 114 is fixed by a fixation device according to an illustrative embodiment of the present invention which controls a film thickness of a foam-like fixation fluid layer based on image information from the light exposure devices that are not illustrated in any of the figures. That is, a foam-like fixation fluid in an illustrative embodiment of the present invention fed from a toner fixation device is provided to the unfixed toner image transferred to the recording paper sheet 114, wherein the film thickness of a foam-like fixation fluid layer is controlled based on image information from light exposure devices that are not illustrated in any of the figures, for example, based on a color image or a black solid image, and the unfixed toner image is fixed on the recording paper sheet 114 by a component agent (softening agent) for dissolving or swelling at least a portion of a resin contained in the toner which agent is contained in the foam-like fixation fluid.

Next, an image forming unit will be described below. As illustrated in FIG. 7B, a charging device 117, a light exposure device (that is not illustrated in the figure) from which laser light L dependent on an image signal is radiated, a developing device 118, a cleaning device 119, and a charge eliminating device 120 are arranged around a photoconductor drum 116 in each of the image forming units 105-108. Furthermore, a primary transfer device 121 is provided at a location opposing to the photoconductor drum 116 while interposing an intermediate transfer belt 101. Moreover, the charging device 117 is a contact-charging-type charging device that employs a charging roller. The charging device 117 brings the charging roller into contact with the photoconductor drum 116 and applies an electric voltage to the photoconductor drum 116 so that the surface of the photoconductor drum 116 is charged uniformly. For the charging device 117, it may also be possible to employ a non-contact-charging-type charging device that employs a non-contact scorotron or the like. Furthermore, the developing device 118 makes a toner in a developer adhere to an electrostatic latent image on the photoconductor drum 116 thereby making the electrostatic latent image visible. Herein, a toner corresponding to each color is composed of a resin material colored with each color and such a resin material is dissolved or swelled by a fixation fluid in an illustrative embodiment of the present invention. Additionally, the developing device 118 includes an agitation part and developing part that are not illustrated in the figure, wherein a developer that is not used for development is returned to the agitation part and recycled. The density of a toner in the agitation part is detected by a toner density sensor and the density of the toner is controlled so as to be constant. Moreover, the primary transfer device 121 transfers a visible toner image on the photoconductor drum 116 to the intermediate transfer belt 101. Herein, a transfer roller is employed for the primary transfer device 121 wherein the transfer roller is pressed against the photoconductor drum 116 while interposing the intermediate transfer belt 101. For the primary transfer device 121, it may also be possible to employ an electrically conductive brush, a non-contact corona charger, or the like. Furthermore, the cleaning device 119 removes an unnecessary toner on the photoconductor drum 116. For the cleaning device 119, it may be possible to use a blade with a tip that is to be pressed against the photoconductor drum 116. Herein, a toner recovered by the cleaning device 119 is recovered into the developing device 118 and recycled by a recovery screw and toner recycling device that are not illustrated in the figure. Moreover, the charge eliminating device 120 is composed of a lamp and irradiates the photoconductor drum 116 with light so as to initialize its surface electric potential.

Next, some specific examples of a fixation fluid and fixation in an illustrative embodiment of the present invention will be described below.

Specific Example 1

Formulation of a Fluid Containing a Softening Agent (Softening Agent Fluid)

| | | |
|---|---|---|
| Softening agent: | propylene carbonate | 90 wt % |
| Thickening agent: | propylene glycol | 10 wt % |

After mixing the above-mentioned fluids, bubbling with a dried nitrogen gas was conducted for 10 minutes so as to remove its water content. Its pH was 5.8.

Formulation of a Fluid Containing a Foaming Agent (Foaming Agent Fluid)

| | | |
|---|---|---|
| Dilution medium: | water | 95 wt % |
| Bubble-increasing agent: | Coconut oil fatty acid diethanolamide (1:1) type (Matsumoto Yushi-Seiyaku Co., Ltd., Marpon MM) | 0.5 wt % |
| Foaming agents: | ammonium palmiate | 2.5 wt % |
| | ammonium myristate | 1.5 wt % |
| | ammonium stearate | 0.5 wt % |

The above-mentioned fluids were mixed and diethanolamine was added such that its pH was adjusted so as to be 9.

Each of the foaming agent fluid and the softening agent fluid was contained in a container made of an aluminized polyethylene resin so as to provide a storage container.

Method for Mixing a Softening Agent Fluid and a Foaming Agent Fluid and Foaming a Fixation Fluid As illustrated in FIG. 1, a feed pipe made of a silicone rubber was connected to each of a container containing a foaming agent fluid and a container containing a softening agent fluid and each feed rubber was connected to each tube pump, so as to connect to a bubbling vessel. The rates of flow of the softening agent fluid and foaming agent fluid due to each tube pump were set at 1.65 mL/minute and 3.35 mL/minute, respectively, and the pump was operated for 6 seconds so as to conduct feeding thereof to the bubbling vessel. Due to such an operation, 0.5 mL of a fixation fluid containing about 30 wt % of the softening agent was fed into the bubbling vessel. The tube pump was operated for 6 seconds and subsequently stopped, and a diaphragm-type air pump was operated so that the softening agent fluid and the foaming agent fluid were agitated and foamed by means of bubbling in the bubbling vessel to provide a fixation fluid with large bubbles.

An inner cylinder of a double cylinder as illustrated in FIG. 1 was fixed with respect to its rotational axis and rotated by a rotation driving motor that is not illustrated in the figure. The material of the double cylinder was a PET resin. The inner diameter and length of an outer cylinder were 10 mm and 120 mm, respectively, while the outer diameter and length of the inner cylinder were 8 mm and 100 mm, respectively. The rotational frequency thereof was variable in a range of 1,000 rpm to 2,000 rpm. The fixation fluid with large bubbles was fed into such a cylinder and a foam-like fixation fluid was manufactured.

Method for Providing a Fixation Fluid

As illustrated in FIG. 1, the manufactured foam-like fixation fluid was fed to a blade. The gap between the blade and an application roller was 40 μm.

There were provided:

a pressurizing roller: a sponge roller in which a roller made of aluminum alloy (ϕ 10 mm) was a cored bar and a polyurethane foam material with a outer diameter of ϕ 50 mm (INOAC CORPORATION, commercial name "Color Foam EMO") was formed thereon;

an application roller: a roller made of SUS which was baking-finished with a PFA resin (ϕ 30 mm);

a linear velocity of 300 mm/s;

a film thickness control blade: a sheet glass with a thickness of 1 mm was bonded to a supporting plate made of an aluminum alloy, wherein its glass surface faced an application roller side and it was possible to control the gap between the application roller and the glass surface in a range of 10 μm to 100 μm; and a paper sheet conveyance speed: 300 mm/s.

<Results of Experiment>

The results of experiment in the case where the softening agent fluid and foaming agent fluid as illustrated in the above-mentioned specific example 1 were used will be provided below.

A PPC paper sheet (Ricoh T-6200) on which a color image of an unfixed toner which was a full-face solid image composed of a magenta color toner layer and a yellow color toner layer (the yellow toner layer on the magenta toner layer) was formed was manufactured by using an electrophotographic color copying machine (produced by Ricoh Company, Ltd., CX2500). When the feed pumps for the softening agent fluid and the foaming agent fluid were preliminarily operated for 6 seconds and subsequently stopped and the air pump was operated simultaneously with stopping thereof while the inner cylinder of the double cylinder was rotated, a foam-like fixation fluid was fed from a foam-like fixation fluid feed orifice to the space between the application roller and the film thickness control blade at 3 seconds after start of the operation of the air pump. Then, the pH of the fixation fluid was 8.1 and the density of the foam-like fixation fluid was approximately 0.03 g/cm$^3$. At the timing of start of feeding the foam-like fixation fluid to the film thickness control blade, the paper sheet on which the unfixed toner image was formed was inserted toward the application roller while the application roller was operated. A foam-like fixation fluid film with a film thickness of about 80 μm was formed on a surface of the application roller uniformly and the foam-like fixation fluid was provided on a paper surface uniformly. After the foam-like fixation fluid was provided, uniform fixation of a toner image surface was attained, wherein the color difference or dispersion between the vicinity of four corners of the paper sheet and the vicinity of its center thereof was 2% or less on a reflection-type densitometer.

Comparative Example 1

Next, an example of the case where a softening agent fluid and a foaming agent fluid are mixed preliminarily will be provided as comparative example 1.

The softening agent fluid and foaming agent fluid illustrated in the above-mentioned specific example 1 were used and sufficiently mixed at a weight ratio of 33:67 so that a mixed fluid (fixation fluid) with a component ratio equivalent to that of the above-mentioned specific example 1 was prepared. The pH of the fixation fluid in comparative example 1 was 8.2. Then, after the mixed fluid (fixation fluid) composed of the softening agent fluid and the foaming agent fluid was heated at 60° C. and left for a certain amount of time and the temperature of the fluid was brought back to room temperature for each period of time for leaving them, a fixation test as mentioned above was conducted. The results of experiments for comparing the above-mentioned specific example 1 and comparative example 1 will be provided in Table 1 below.

Herein, for tests of leaving them after warming them at 60° C., tests of acceleration of their degradation caused by warming and leaving them were conducted. These were numerical values calculated or obtained by acceleration tests based on heating at 60° C. (Arrhenius method). That is, tests based on warming them at 60° C. for 1 day indicated that they were left at 25° C. (ordinary temperature) for 1 month and tests based on warming them at 60° C. for 20 days corresponded to leaving them at 25° C. (ordinary temperature) for 1 year. In table 1, the contents of the results of tests based on leaving them at 25° C. (ordinary temperature) are provided.

TABLE 1

| | Just after manufacturing | 1 month later | 1 year later |
|---|---|---|---|
| Specific example | A | A | A |
| Comparative example | A | B | B |

First, in regard to a result of "B" based on the standard of evaluations in Table 1, "B" indicates the case where a toner after its fixation was rubbed with a cloth and then most of the toner was removed from a paper sheet. Furthermore, in regard to a result of "A" therein, "A" indicates the case where a toner after its fixation was rubbed with a cloth and then the fixation was attained well on the condition that the cloth was rarely contaminated. In the results of evaluations in Table 1, the fixation property of specific example 1 was good even if it was left for a long term after 1 year. On the other hand, when comparative example 1 was left for 1 month or more, most of its fixation property was lost. This was a result caused in the case where the softening agent fluid and the foaming agent fluid were preliminarily mixed in comparative example 1, and indicated that, in such a case of preliminary mixing, an ester component of the softening agent was decomposed by its hydrolysis whereby fixation of the toner was not sufficiently attained. Hence, it was found that it may be possible to dramatically improve a storage stability of a storage container filled with a fixation fluid in an illustrative embodiment of the present invention in which embodiment a softening agent fluid and a foaming agent fluid are stored independently and mixed immediately before their use so as to provide a fixation fluid.

Specific Example 2

The formulations of a foaming agent fluid and softening agent fluid were the same as those of specific example 1.

Method for Mixing a Softening Agent Fluid and a Foaming Agent Fluid and Foaming a Fixation Fluid As illustrated in FIG. 2, a feed pipe made of a silicone rubber was connected to each of a container containing a foaming agent fluid and a container containing a softening agent fluid and each feed rubber was connected to each tube pump, so as to supply a fluid agitation vessel with a volume of 0.5 mL. The rates of flow of the softening agent fluid and foaming agent fluid fed from each tube pump were set at 1.65 mL/minute and 3.35 mL/minute, respectively, and the pump was operated for 6 seconds so as to conduct feeding thereof to the fluid agitation vessel. Due to such an operation, 0.5 mL of a fixation fluid containing about 30 wt % of the softening agent was fed into the fluid agitation vessel. In the fluid agitation vessel, an agitation blade composed of two blades was installed and rotated at 120 rpm. In the fluid agitation vessel, the foaming agent fluid and the softening agent fluid were mixed and sealed therein, and the tube pump was operated again such that a mixed fluid (fixation fluid) in the fluid agitation vessel was fed into a bubbling vessel. The tube pump was operated for 6 seconds and subsequently stopped, and a diaphragm-type air pump was operated so that its foaming (bubbling) was conducted by means of bubbling in the bubbling vessel to provide a fixation fluid with large bubbles. A series of subsequent operations for producing a foam-like fixation fluid from such large bubbles was the same as that of specific example 1. It was confirmed that the density of thus obtained foam-like fixation fluid was 0.017 g/cm$^3$ and the density was smaller than the density of 0.03 g/cm$^3$ in specific example 1 and an agitation mechanism was provided so that it was possible to manufacture a foam-like fixation fluid that was further excellent in its foaming property.

Specific Example 3

The formulations of a foaming agent fluid and softening agent fluid were the same as those of specific example 1.

Method for Mixing a Softening Agent Fluid and a Foaming Agent Fluid and Foaming a Fixation Fluid As illustrated in FIG. 3, a feed pipe made of a silicone rubber was connected to each of a container containing a foaming agent fluid and a container containing a softening agent fluid and each feed rubber was connected to each tube pump, so as to supply a fluid agitation vessel with a volume of 0.5 mL. The rates of flow of the softening agent fluid and foaming agent fluid fed from each tube pump were set at 1.65 mL/minute and 3.35 mL/minute, respectively, and the pump was operated for 6 seconds so as to conduct feeding thereof to a fluid agitation part. Due to such an operation, 0.5 mL of a mixed fluid (fixation fluid) containing about 30 wt % of the softening agent was fed from the exit of a flow channel for mixed fluid after passing through the fluid agitation part.

The fluid agitation part was made of an aluminum alloy and the size of each of a flow channel for foaming agent fluid and a flow channel for softening agent fluid had a width of 0.5 mm, a length of 3 mm and a depth of 0.5 mm. The entrance of the flow channel for mixed fluid was provided with an orifice with a width of 0.1 mm, a depth of 0.5 mm and a length of 1 mm and its size except the orifice had a width of 0.5 mm, a length of 3 mm and a depth of 0.5 mm, wherein the fluid resistance of the flow channel for mixed fluid was higher than those of the two flow channels mentioned above.

When only the foaming agent fluid was colored blue with a dye of Blue No. 1 and the mixed fluid was observed in order to check whether or not both the foaming agent fluid and the softening agent fluid were sufficiently agitated in the flow channel for mixed fluid, no colored spot was found in the mixed fluid but uniformly blue coloring was found so that it was confirmed that the foaming agent fluid and the softening agent fluid were mixed sufficiently.

The mixed fluid (fixation fluid) after passing through the fluid agitation part was fed into a bubbling vessel. The tube pump was operated for 6 seconds and subsequently stopped, and a diaphragm-type air pump was operated so that its bubbling in the bubbling vessel was conducted to provide a fixation fluid with large bubbles. A series of subsequent operations for producing a foam-like fixation fluid from such large bubbles was the same as that of specific example 1. It was confirmed that the density of thus obtained foam-like fixation fluid was 0.02 g/cm$^3$ and the density was smaller than the density of 0.03 g/cm$^3$ in specific example 1, and even if only a difference between the fluid resistances of the flow channels was provided without using a motor operation for agitation or the like, it was possible to agitate the foaming agent fluid and the softening agent fluid sufficiently so as to manufacture a foam-like fixation fluid excellent in its foaming property.

Specific Example 4

An aluminized polyethylene container having an accordion structure (and a volume of 300 mL) as illustrated in FIG. 6 was filled with the softening agent fluid in specific example 1 without containing air. On the other hand, an aluminized polyethylene container having an accordion structure (and a volume of 700 mL) was filled with the foaming agent fluid in specific example 1 without containing air. A fixation device was provided with two single-shaft actuators utilizing a stepping motor and a ball screw, so that it was possible to pressurize the container filled with the foaming agent fluid and the container filled with the softening agent fluid as illustrated in FIG. 6. The rates of strokes of respective actuators were adjusted to be 1.65 mL/minute for the softening agent fluid and 3.35 mL/minute for the foaming agent fluid. Feed pipes made of a polyethylene and having an inner diameter of 1 mm were attached to the feed orifices of the two storage containers, and as illustrated in FIG. 6, both pipes were joined together so as to provide a pipe for feeding a mixed fluid. Rotatable toothed wheels like water wheels were provided at two positions in the pipe for feeding a mixed fluid so that the toothed wheels rotated due to a fluid flow through the pipe.

When only the foaming agent fluid was colored blue with Blue No. 1 and the actuators were operated, a fixation fluid which was uniformly colored a pale blue was fed from a fixation-fluid-feeding orifice of a fixation fluid storage container whereby it was confirmed that it was possible to mix the foaming agent fluid and the softening agent fluid uniformly in the storage container in an illustrative embodiment of the present invention.

Then, from Table 2 indicating the results from adjustment of its pH by means of a pH adjustor to confirm the relationship between the pH of each fixation fluid with a predetermined pH and its foaming property, it was found that the pH of the fixation fluid was most excellent in its foaming property on the condition that its pH was 7 or more and 9 or less. Additionally, the foaming property was determined by a foam density wherein the lower the density was, the better the foaming property was determined to be. Furthermore, foaming itself was not necessarily regarded as a good foaming property, and the condition that foam was retained after foaming should be regarded as a good foaming property. Then, when foam was retained, a foam density was small accordingly, and hence, such a foam density was one measure for evaluating a foaming property.

TABLE 2

| | pH of fixation fluid | | | | |
|---|---|---|---|---|---|
| | 5.5 | 6.5 | 7.0 | 8.0 | 9.0 |
| Density of foam (mg/cm$^3$) | Non-foamable | 0.12 | 0.027 | 0.023 | 0.021 |
| Foaming property | — | No good | Good | Good | Good |

APPENDIX

Typical embodiments (1) to (14) of the present invention will be described below.

Embodiment (1) is a fixation device for foaming a fixation fluid which contains at least a softening agent for dissolving or swelling at least one portion of a resin so as to soften a resin-containing fine particle which contains a resin, a foaming agent, and water, and providing a foamed or foam-like fixation fluid to the resin-containing fine particle so as to fix it while a film thickness thereof is controlled, wherein the fixation device is characterized by including a first storage part for containing a softening agent fluid which contains at least the softening agent, a second storage part for containing a foaming agent fluid which contains at least the foaming agent, and a mixed foamed or foam-like fixation fluid producing part for mixing and foaming both fluids contained in independent states in the respective storage parts so as to produce a foam-like fixation fluid.

Embodiment (2) is the fixation device as described in embodiment (1) above, characterized in that a pH of the softening agent fluid contained in the first storage part is adjusted to have an acidic property and a pH of the foaming agent fluid contained in the second storage part is adjusted to have an alkaline property.

Embodiment (3) is the fixation device as described in embodiment (1) or (2) above, characterized in that the mixed foamed or foam-like fixation fluid producing part includes a mixed fluid producing part for mixing both fluids contained in independent states in the respective storage parts so as to produce a mixed fluid and a foamed or foam-like fixation fluid producing part for foaming the mixed fluid so as to produce a foamed or foam-like fixation fluid.

Embodiment (4) is the fixation device as described in any one of embodiments (1) to (3) above, characterized in that production of a foamed or foam-like fixation fluid by the mixed foamed or foam-like fixation fluid producing part is conducted at a time of starting of the device.

Embodiment (5) is the fixation device as described in embodiment (3) above, characterized in that the mixed fluid producing part includes an agitation mechanism.

Embodiment (6) is the fixation device as described in any one of embodiments (1) to (5) above, characterized by including feed channels for feeding the softening agent fluid and the foaming agent fluid from the first storage part and the second storage part, respectively, wherein a fluid resistance of a channel junction at which the respective feed channels join together is smaller than a fluid resistance of each feed channel.

Embodiment (7) is an image forming apparatus characterized by including an image forming part for conducting an electrostatic recording process with a toner in which a resin-containing fine particle contains a coloring agent so as to form an unfixed toner image on a medium and a fixation part for fixing the unfixed toner image on the medium by the fixation device as described in any one of embodiments (1) to (6) above.

Embodiment (8) is a fixation fluid storage container for containing a fixation fluid for which a mixed fluid which contains at least a softening agent for dissolving or swelling at least one portion of a resin so as to soften a resin-containing fine particle which contains a resin, a foaming agent, and water is produced, then the mixed fluid is foamed, and subsequently it is provided to the resin-containing fine particle so as to fix it, wherein the fixation fluid storage container is characterized in that the fixation fluid storage container includes a first storage part for containing a softening agent fluid which contains at least the softening agent and a second storage part for containing a foaming agent fluid which contains at least the foaming agent and is provided on a condition that the softening agent fluid is independent of the foaming agent fluid.

Embodiment (9) is the fixation fluid storage container as described in embodiment (8) above, wherein the first storage part and/or the second storage part are/is attachable and detachable.

Embodiment (10) is the fixation fluid storage container as described in embodiment (8) or (9) above, characterized by including a feed channel for the softening agent fluid and a feed channel for the foaming agent fluid in the container and including a mixing and agitating part for mixing and agitating both fluids at a position at which both of the feed channels join together.

Embodiment (11) is the fixation fluid storage container as described in any one of embodiments (8) to (10) above, characterized in that the first storage part includes a first communicating part which communicates with a feed channel for the softening agent fluid and the second storage part includes a second communicating part which communicates with a feed channel for the foaming agent fluid.

Embodiment (12) is the fixation fluid storage container as described in embodiment (11) above, characterized in that the first communicating part includes a sealing rubber for sealing the softening agent fluid to be contained, into which a needle-like feed pipe which communicates with a feed channel for the softening agent fluid at a fixation device side is stuck so as to communicate a containment part of the first storage part with the feed channel for the softening agent fluid at a fixation device side, and the second communicating part includes a sealing rubber for sealing the foaming agent fluid to be contained, into which a needle-like feed pipe which communicates with a feed channel for the foaming agent fluid at a fixation device side is stuck so as to communicate a containment part of the second storage part with the feed channel for the foaming agent fluid at a fixation device side.

Embodiment (13) is the fixation fluid storage container as described in any one of embodiments (8) to (12) above, characterized in that the first storage part and the second storage part are containers having an accordion structure and having a push-out part for pushing a fluid to be contained in each container out thereof.

Embodiment (14) is the fixation fluid storage container as described in embodiment (13) above, characterized in that the push-out part is configured by using a pressuring actuator.

Although the illustrative embodiments and specific examples of the present invention have been described above with reference to the accompanying drawings, the present invention is not limited to any of the illustrative embodiments and specific examples and the illustrative embodiments and specific examples may be altered, modified, or combined without departing from the scope of the present invention.

The present application claims the benefit of its priority based on Japanese Patent Application No. 2009-030590 filed on Feb. 13, 2009 in Japan and Japanese Patent Application No. 2009-167327 filed on Jul. 16, 2009 in Japan, the entire contents of which are hereby incorporated by reference herein.

The invention claimed is:

1. A fixation device of fixing a resin-containing fine particle, the fixation device being configured to foam a fixation fluid including at least a softening agent configured to dissolve or swell at least one portion of a resin to soften the resin-containing fine particle including a resin, a foaming agent, and water; and to provide a foamed fixation fluid to the resin-containing fine particle, the fixation device comprising:

a first storage part configured to contain a softening agent fluid including at least the softening agent;

a second storage part configured to contain a foaming agent fluid including at least the foaming agent; and a mixed foamed fixation fluid producing part configured to mix and foam both fluids contained in independent states in the storage parts to produce the foamed fixation fluid.

2. The fixation device as claimed in claim 1, wherein the softening agent fluid contained in the first storage part has a pH adjusted to have an acidic property and the foaming agent fluid contained in the second storage part has a pH adjusted to have an alkaline property.

3. The fixation device as claimed in claim 1, wherein the mixed foamed fixation fluid producing part comprises a mixed fluid producing part configured to mix both fluids contained in independent states in the respective storage parts to produce a mixed fluid and a foamed fixation fluid producing part configured to foam the mixed fluid to produce the foamed fixation fluid.

4. The fixation device as claimed in claim 1, wherein the mixed foamed fixation fluid producing part is configured to produce the foamed fixation fluid at a time of starting of the fixation device.

5. The fixation device as claimed in claim 3, wherein the mixed fluid producing part comprises an agitation mechanism.

6. The fixation device as claimed in claim 1, wherein the fixation device further comprises a feed channel configured to feed the softening agent fluid from the first storage part, and a feed channel configured to feed the foaming agent fluid from the second storage part, the feed channels joining together at a channel junction; and a fluid resistance of the channel junction is smaller than a fluid resistance of each feed channel.

7. An image forming apparatus comprising:

an image forming part configured to conduct an electrostatic recording process with a toner to form an unfixed toner image on a medium, a resin-containing fine particle in the toner including a coloring agent; and a fixation part configured to fix the unfixed toner image on the medium, the fixation part including the fixation device as claimed in claim 1.

8. A fixation fluid storage container of containing a fixation fluid, the fixation fluid being provided by producing a mixed fluid including at least a softening agent configured to dissolve or swell at least one portion of a resin to soften a resin-containing fine particle including a resin, a foaming agent, and water; and foaming the mixed fluid, the mixed fluid being provided to the resin-containing fine particle to fix the resin-containing fine particle, the fixation fluid storage container comprising:

a first storage part configured to contain a softening agent fluid including at least the softening agent; and a second storage part configured to contain a foaming agent fluid including at least the foaming agent; wherein the fixation fluid storage container is configured such that the softening agent fluid is independent of the foaming agent fluid.

9. The fixation fluid storage container as claimed in claim 8, wherein the first storage part and/or the second storage part are/is attachable and detachable.

10. The fixation fluid storage container as claimed in claim 8, wherein the fixation fluid storage container further comprises a feed channel for the softening agent fluid, a feed channel for the foaming agent fluid, and a mixing and agitating part configured to mix and agitate both fluids at a position, both of the feed channels joining together at the position.

11. The fixation fluid storage container as claimed in claim 8, wherein the first storage part includes a first communicating part communicating with a feed channel for the softening agent fluid and the second storage part includes a second communicating part communicating with a feed channel for the foaming agent fluid.

12. The fixation fluid storage container as claimed in claim 11, wherein the first communicating part includes a first sealing rubber configured to seal the softening agent fluid to be contained, a first needle-like feed pipe communicating with the feed channel for the softening agent fluid at a fixation device side is stuck into the first sealing rubber to allow communication of a containment part of the first storage part with the feed channel for the softening agent fluid at a fixation device side; and the second communicating part includes a second sealing rubber configured to seal the foaming agent fluid to be contained, a second needle-like feed pipe communicating with the feed channel for the foaming agent fluid at a fixation device side is stuck into the second sealing rubber to allow communication of a containment part of the second storage part with the feed channel for the foaming agent fluid at a fixation device side.

13. The fixation fluid storage container as claimed in claim 8, wherein the first storage part and the second storage part are containers including an accordion structure and having a push-out part configured to push the fluid contained in each container out of the container.

14. The fixation fluid storage container as claimed in claim 13, wherein the push-out part includes a pressuring actuator.

* * * * *